United States Patent [19]

Parham

[11] Patent Number: 5,066,261

[45] Date of Patent: Nov. 19, 1991

[54] COIN HOPPER ASSEMBLY

[76] Inventor: Michael O. Parham, 5801 Evergreen, Las Vegas, Nev. 89107

[21] Appl. No.: 482,819

[22] Filed: Feb. 21, 1990

[51] Int. Cl.[5] ..... G07D 1/00

[52] U.S. Cl. ..... 453/57; 221/182; 221/267

[58] Field of Search ..... 453/30, 32, 49, 57; 221/160, 161, 167, 168, 182, 267

[56] References Cited

U.S. PATENT DOCUMENTS

| | | | |
|---|---|---|---|
| 1,279,351 | 9/1918 | Jorgensen et al. | 453/57 X |
| 3,396,737 | 8/1968 | Picollo | 453/57 X |
| 3,680,566 | 8/1972 | Tanaka et al. | 221/167 X |
| 3,942,544 | 3/1976 | Breitenstein | 453/57 |
| 4,518,001 | 5/1985 | Branham | 453/49 |
| 4,589,433 | 5/1986 | Abe | 453/57 |
| 4,615,350 | 10/1986 | Boudville | 453/57 |

*Primary Examiner*—F. J. Bartuska
*Attorney, Agent, or Firm*—Quirk, Tratos & Roethel

[57] ABSTRACT

A coin hopper is provided with a rotary pin wheel for feeding coins to a pay out mechanism. A wiper member is mounted adjacent the rotary pin wheel slightly removed from the position at which the rotary pin wheel feeds coins to the pay out mechanism. The wiper member functions to wipe extra coins off the rotary pin wheel and return them to the hopper basket so that each location on the rotary pin wheel is occupied by only a single coin. A guide member is provided adjacent the position at which the rotary pin wheel feeds coins to the pay out mechanism. The guide member aligns the coins being fed into the pay out mechanism to ensure that the coins enter the pay out mechanism in a flat upright, on edge orientation.

11 Claims, 3 Drawing Sheets

COIN HOPPER ASSEMBLY

This invention relates to a coin hopper assembly, and more particularly to a coin hopper assembly designed to minimize jamming of coins when coins are being dispensed from the coin hopper.

BACKGROUND OF THE INVENTION

Coin hoppers have been used for many years in coin operated gaming devices, such as slot machines or video poker machines, to receive coins that have been introduced into the machine by the player and to also pay out coins to the player when a win occurs. Coin hoppers have been designed in many configurations, and one of the conventional configurations uses a rotary pin wheel mechanism to feed the coins to the pay out mechanism for delivery to the coin tray. Typical of such a configuration is the coin hopper shown in U.S. Pat. No. 3,942,544 (Breitenstein et al.).

Rotary pin wheel coin hoppers have also been designed with elongated or escalator chutes if the coin tray is situated at a location above the level of coin hopper. This design is most typically used for gaming devices mounted in the tables or counter tops such as in a bar. Typical of this design is the coin hopper shown in U.S. Pat. No. 4,518,001 (Branham).

In a typical rotary pin wheel design coin hopper, the pay out mechanism is positioned tangentially to the edge of the rotary pin wheel and receives coins edgewise from the pin wheel. The pay out mechanism has the configuration of a slot and should receive one coin at a time. If the pin wheel malfunctions and attempts to feed two coins at once to the pay out mechanism, the coin hopper jams and ceases operation. An attendant must then be called to clear the coin jam. Until the attendant arrives and corrects the malfunction, the gaming device is inoperable resulting in player dissatisfaction and lost revenue to the operator.

The Breitenstein et al. patent shows what is referred to as a preconditioning wiper 16 that has a tapered and yieldable finger 17. The yieldable finger 17 is nothing more than a piece of spring steel oriented in the direction of movement of the coins on the pinwheel. This design is not effective in preventing multiple coins in a single pinwheel slot from passing by and jamming the pay out chute.

It is an object of the present invention to provide a coin hopper that minimizes, if not wholly eliminates, coin jams in the area of the rotary pin wheel and the pay out mechanism.

It is a feature of the present invention to include a guide member adjacent the pay out mechanism and a wiper member adjacent pin wheel to prevent more than one coin from being fed at a time from the pin wheel to the pay out mechanism.

It is an advantage of the present invention that coin jams are minimized, if not wholly eliminated, thereby improving player acceptance of the gaming device and increasing revenue to the operator by decreasing the amount of time that the gaming device is inoperable.

SUMMARY OF THE INVENTION

A coin hopper is provided with a rotary pin wheel for feeding coins to a pay out mechanism. A wiper member is mounted adjacent the rotary pin wheel slightly removed from the position at which the rotary pin wheel feeds coins to the pay out mechanism. The wiper member functions to wipe extra coins off the rotary pin wheel and return them to the hopper basket so that each location on the rotary pin wheel is occupied by only a single coin. A guide member is provided adjacent the position at which the rotary pin wheel feeds coins to the pay out mechanism. The guide member aligns the coins being fed into the pay out mechanism to ensure that the coins enter the pay out mechanism in a flat upright, on edge orientation.

DETAILED DESCRIPTION OF THE PREFERRED EMBODIMENTS

Figure 1:
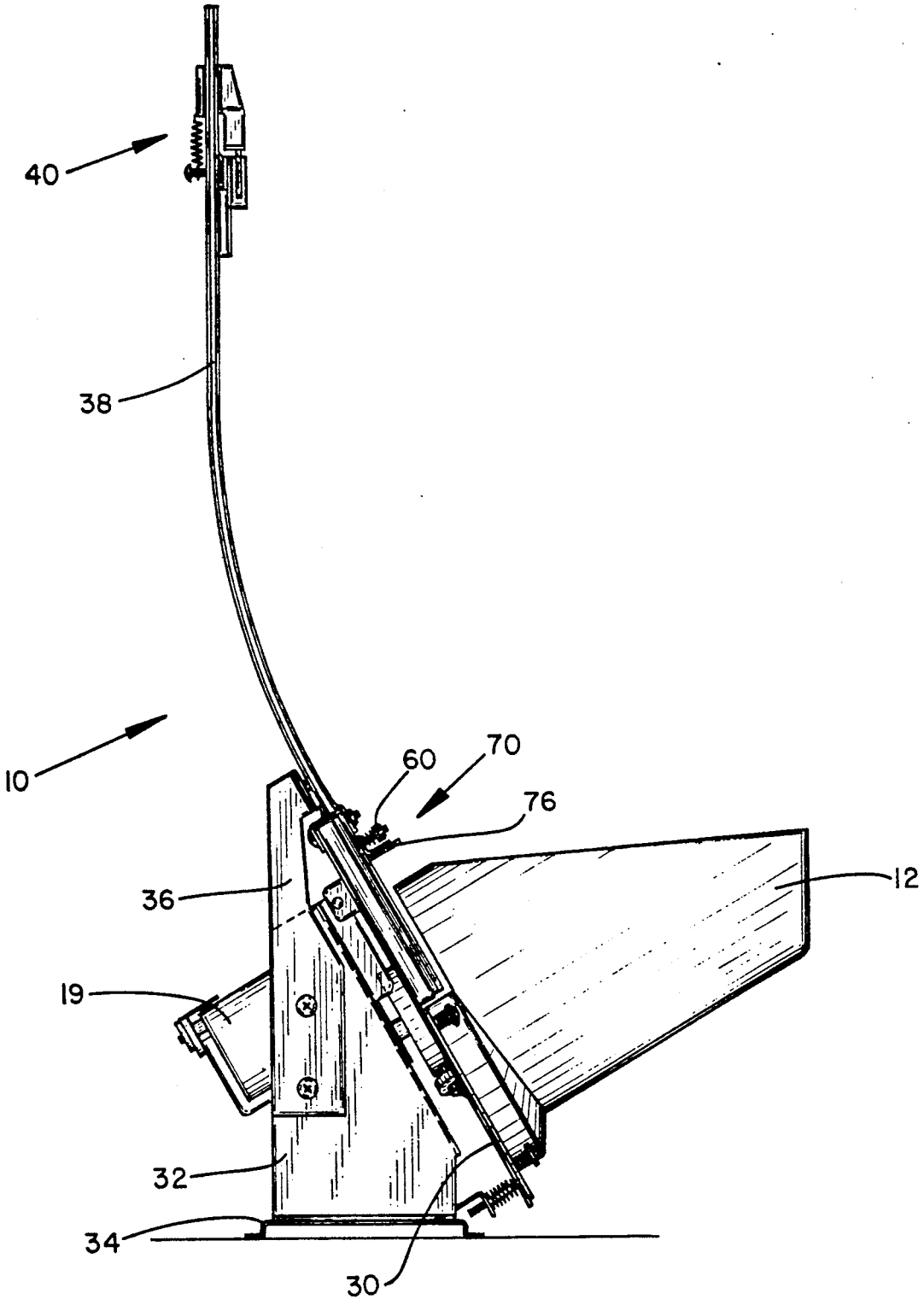
FIG. 1 shows a side view of the coin hopper assembly of the present invention with an escalator pay out mechanism attached.
Figure 2:
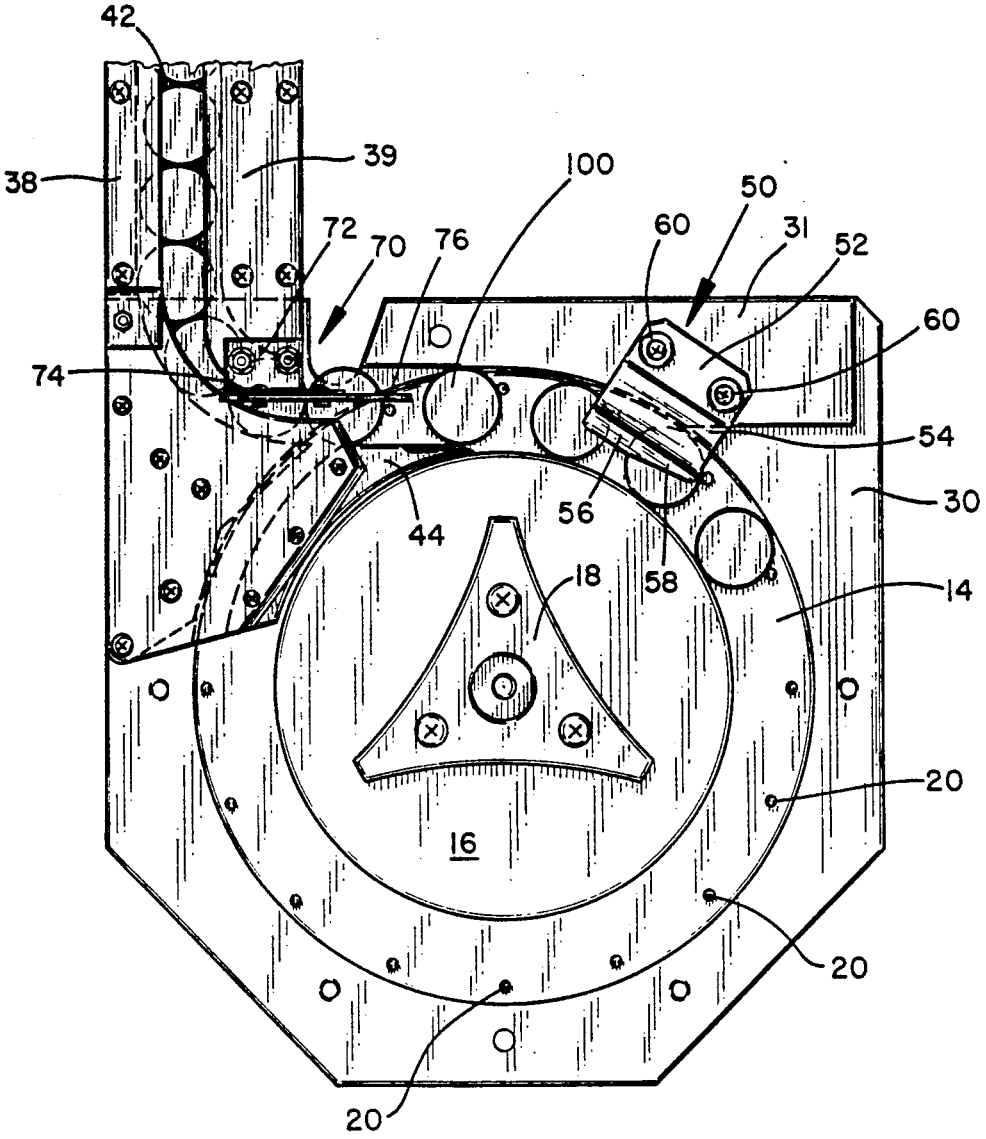
FIG. 2 shows a front view, with the hopper removed, of the coin hopper assembly of the present invention.

The coin hopper assembly of the present invention is shown generally at 10 in FIGS. 1 and 2. The coin hopper assembly 10 comprises a hopper basket 12 mounted on a back plate 30 which in turn is mounted on a hopper frame 32. The hopper frame 32 is fastened to a base plate 34 by which the hopper frame 32 can be mounted in a gaming machine (not shown).

The hopper basket 12 contains a plurality of coins which, upon a winning play achieved, are dispensed to a player. Upon receiving a pay out signal from a control mechanism, a motor causes a pin wheel 14 and a shelf plate 16 to be rotated in a counter clockwise direction. A pyramid mixer 18 agitates the coins in the hopper basket 12 and each coin 100 to be dispensed aligns itself on edge in an upright position on the pin wheel 14 between adjacent dowel pins 20 with the bottom of each coin 100 resting on the shelf plate 16. A hopper motor 19 mounted on the hopper frame 32 provides the power to rotate the pin wheel 14 and the shelf plate 16 through a drive shaft (not shown) attached to the shelf plate 16.

As the pin wheel 14 rotates to its top, each coin 100 passes from the shelf plate 16 to a hopper knife 44 at the entrance to an elongated chute or escalator chute 38. The hopper knife 44 functions as an entry shelf to allow the coin 100 to pass from the pin wheel 14 to the elongated chute 38. The elongated chute 38 is supported adjacent to the coin hopper assembly 10 and braced by means of a brace member 36 mounted on the hopper frame 32. Each coin 100 progresses upwardly in the coin channel 42 of the elongated chute 38 moved along by the force of the trailing coins. Eventually the coins reach a coin ejector 40 from which the coins are dispensed to a pay out tray (not shown) which is accessible to the player. This structure is conventional and is shown in further detail in U.S. Pat. No. 4,518,001 (Branham), which is incorporated herein by this reference thereto.

As an alternative arrangement to the elongated or escalator pay out chute shown in the Branham patent, a standard pay out chute could also be used such as shown in U.S. Pat. No. 3,942,544 (Breitenstein et al.), which is also incorporated herein by this reference thereto.

As the pin wheel 14 and shelf plate 16 rotate and pick up coins from the hopper basket 12, it is possible that more than one coin can become lodged between adjoining sets of dowel pins 20. This is a fairly common occurrence in coin hopper assemblies and is a constant source of difficulty. When this occurs, two or more coins will attempt to enter the entry of the coin channel 42 in the elongated chute 38 and the coin hopper assembly will become jammed. In the event of a jam, the coin hopper assembly shuts down and the gaming device would be out of commission until an attendant can be called to clear the jam.

Figure 4:
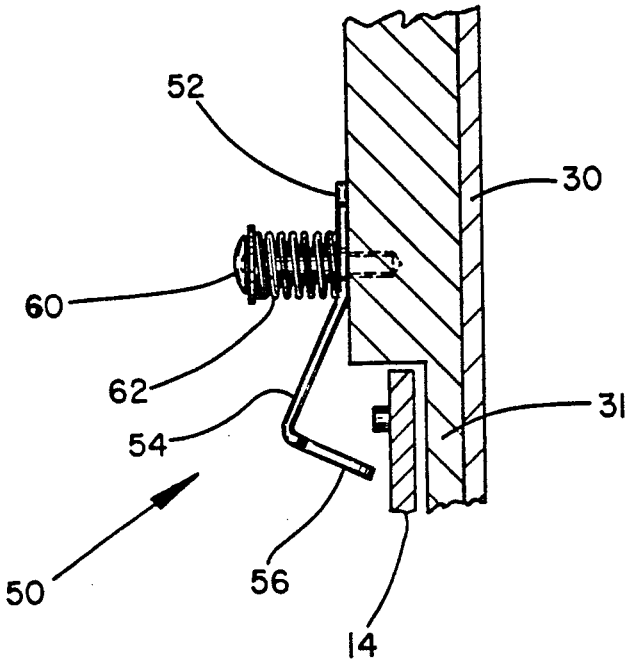
FIG. 4 shows a side view of the guide member portion of the hopper assembly of the present invention from FIG. 2.

In order to obviate coin jams occurring at the entry to the coin channel 42, the present invention utilizes a wiper member 50 mounted adjacent to the pin wheel 14. As shown in FIGS. 2 and 4, the wiper member 50 comprises a generally rectangular mounting piece 52 having one or more apertures that receive mounting screw 60 to connect the wiper member 50 to a mounting plate 31 which in turn is fastened to the back plate 30. Each mounting screw 60 is provided with a tension spring 62 so that the wiper member 50 is held securely against the mounting plate 31, but the wiper member 50 still has a certain amount of play in this connection. Integrally joined to the mounting piece 52 at a slight angle thereto is a center section 54 and on the end of the center section 54 is a end section 56 integrally joined to the center section 54 at approximately a 90° angle. The end section 56 has a tapered coin engaging edge 58 as shown in FIG. 2.

In use, the wiper member 50 is mounted to the mounting plate 31 and adjusted so that the gap between the end section 56 and the pin wheel 14 is approximately the thickness of the coins contained in the hopper basket 12. As the pin wheel 14 and shelf plate 16 rotate, a single coin riding on the shelf plate 16 will pass unaffected past the wiper member 50. If two or more coins share the same compartment between adjoining dowel pins 20, all of the coins but one will be wiped off the pin wheel 14 by the wiper member 50. The tapered coin engaging edge 58 on the end section 56 acts on the flat side of a coin and actually flips any extra coins attempting to pass by on the pin wheel 14 back into the hopper basket 12. The tapered coin engaging edge 58 on the end section 56 also orients the remaining coin in a flat, upright, on-edge orientation on the pin wheel 14 thereby aligning the coin for easy entry onto the hopper knife 44.

The wiper member 50 is mounted to the mounting plate 31 by means of the mounting screws 60. The tension spring 62 mounted around each mounting screw 60 permits lateral outward movement of the wiper member. When two coins side-by-side attempt to pass the wiper member 50, the wiper member 50 moves slightly laterally outwardly relative to the mounting plate 31 as the second coin slides along the tapered coin engaging edge 58. When the second coin moves as far as the movement of the wiper member 50 permits, the wiper member 50 actually flips the second back into the hopper basket 12 and the tension springs 62 return the wiper member 50 to its normal inward position.

Coins also have a tendency to jam up at the entry opening to the pay out chute 38. The entry opening is generally a slot having a rectangular cross section just slightly larger than the thickness and height of a coin 100 on edge. If the coin 100 is not standing upright and aligned with the slot, the coin may not enter the slot and the coin hopper assembly could become jammed. Similarly if two or more coins attempt to enter the slot at the same time, this may cause the coin hopper assembly 10 to jam.

Figure 3:
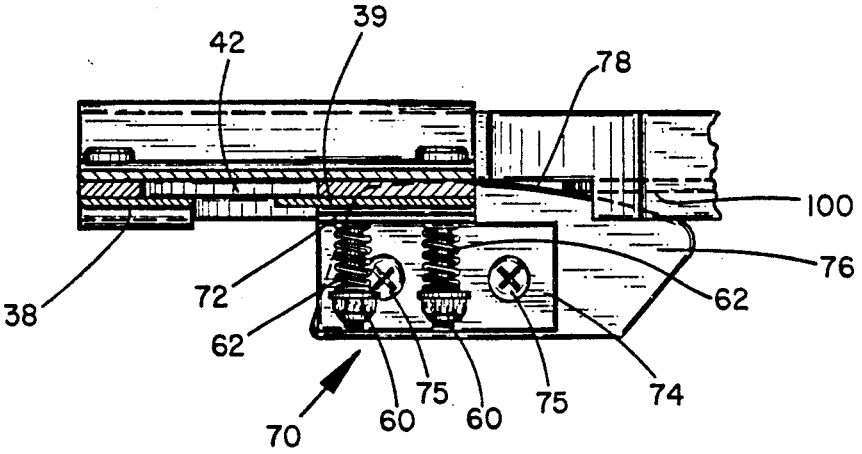
FIG. 3 shows a top view of the wiper member portion of the coin hopper assembly of the present invention from FIG. 2.

The present invention obviates this type of possible coin am by providing a guide member 70 mounted on the end of the elongated chute 38 adjacent the hopper knife 44. The guide member 70 is shown in detail in FIGS. 2 and 3. The guide member 70 comprises a mounting plate 72 having at least one aperture for receiving mounting screw 60 for mounting the guide member 70 to the lower end of one side 39 of the elongated chute 38. Again each mounting screw 60 has an associated tension spring 62 so that when the guide member 70 is mounted to the elongated chute 38, there will be a certain amount of play between the guide member 70 and the elongated chute 38.

Integrally formed to the mounting plate 72 at generally a 90° angle thereto is a bracket 74. Mounted to the bracket 74, preferably by screws 75 is the guide plate 76. The guide plate 76 is a generally rhomboidal piece with one side thereof provided with a tapered coin engaging edge 78.

In use, the guide member 70 is mounted to the lower end of one side 39 of the elongated chute 38 and adjusted so that no opening exists between the guide plate 76 and the wall of the lower end of the elongated chute 38. When a coin passes along the hopper knife 44 and approaches the guide member 70, the tapered coin engaging edge 78 on the guide plate 76 acts on the flat side of the coin 100 and guides each coin into the entry slot of the coin channel 42 and orients the coin in the appropriate flat upright, on-edge position. The guide member 70 moves laterally outwardly from the wall of the elongated chute 38 due to the force of the coin 100 acting on the guide plate 76 thereby providing sufficient room for a coin 100 to pass by.

The tension spring 62 around the mounting screw 60 biases the guide member 70 toward the wall of the elongated chute 38 to inhibit more than one coin 100 from entering the entry slot of the coin channel 42. The tension spring 62 also keeps the guide member 70 firmly against the wall of the lower end of the elongated chute 38 when no coin is passing by such as when the coin hopper assembly 10 is not dispensing coins. Thus the guide plate 76 also prevents coins in the coin channel 42 from sliding backwardly down the coin channel 42 and back into the hopper basket 12.

In the unlikely event that the coins would jam at the entry opening to the coin channel 42, the attendant can simply grasp the guide member 70 and pull it outwardly away from the elongated chute 38 to clear the jam. No disassembly of the guide member 70 is required due to the use of the tension spring 62 around the mounting screw 60.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A coin hopper assembly comprising:

(a) a hopper frame having a mounting plate attached thereto, (b) a hopper basket mounted to the mounting plate, (c) a shelf plate mounted to the mounting plate inside the hopper basket, the shelf plate including a pin wheel, (d) a wiper member mounted to the mounting plate adjacent the pin wheel, the wiper member including an end section having a tapered coin engaging edge disposed generally perpendicular to the plane of travel of the pin wheel whereby only a single coin oriented on the pin wheel may pass by the wiper member, and (e) the wiper member attached to the mounting plate by means of a mounting screw including a tension spring that allows the wiper member to move perpendicularly to the plane of travel of the pin wheel.

2. The coin hopper of claim 1 further including:

(a) a pay out chute mounted on the hopper frame, (b) an hopper knife attached to an entry end of the pay out chute and operatively associated with the hopper basket, and (c) a guide member mounted on the pay out chute and oriented adjacent the hopper knife whereby coins leaving the pin wheel and passing onto the hopper knife are oriented to enter the pay out chute.

3. The coin hopper of claim 2 wherein the guide member is a generally rhomboidal member having a tapered coin engaging edge to orient each coin in a flat upright, on edge position.

4. The coin hopper of claim 2 wherein at least one mounting screw having a tension spring attaches the guide member to the pay out chute.

5. A coin hopper assembly comprising:

(a) a hopper frame having a mounting plate attached thereto, (b) a hopper basket mounted to the mounting plate, (c) a shelf plate mounted to the mounting plate inside the hopper basket, the shelf plate including a pin wheel, (d) a wiper member mounted to the mounting plate adjacent the pin wheel, the wiper member having a tapered coin engaging edge whereby only a single coin oriented on the pin wheel may pass by the wiper member, (e) a pay out chute mounted on the hopper frame, (f) a hopper knife attached to an entry end of the pay out chute and operatively associated with the hopper basket, and (g) a guide member mounted on the pay out chute and oriented adjacent the hopper knife and at least one mounting screw having a tension spring which attaches the guide member to the pay out chute whereby coins leaving the pin wheel and passing onto the hopper knife are oriented to enter the pay out chute.

6. The coin hopper of claim 5 wherein the guide member is a generally rhomboidal member having a tapered coin engaging edge to orient each coin in a flat upright, on edge position.

7. A coin hopper assembly comprising:

(a) a hopper frame having a mounting plate attached thereto, (b) a hopper basket mounted to the mounting plate, (c) a shelf plate mounted to the mounting plate inside the hopper basket, the shelf plate including a pin wheel, and (d) a wiper member mounted to the mounting plate adjacent the pin wheel, the wiper member comprising a generally rectangular mounting piece for mounting the wiper member to the mounting plate, a center section joined to the mounting piece at a slight angle thereto and an end section joined to the center section at an angle of approximately 90°, the end section including a tapered coin engaging edge disposed generally perpendicular to the plane of travel of the pin wheel whereby only a single coin oriented on the pin wheel may pass by the wiper member, and (e) the wiper member attached to the mounting plate by means of a mounting screw including a tension spring that allows the wiper member to move perpendicularly to the plane of travel of the pin wheel.

8. The coin hopper of claim 7 further including:

(a) a pay out chute mounted on the hopper frame, (b) a hopper knife attached to an entry end of the pay out chute and operatively associated with the hopper basket, and (c) a guide member mounted on the pay out chute and oriented adjacent the hopper knife whereby coins leaving the pin wheel and passing onto the hopper knife are oriented to enter the pay out chute.

9. The coin hopper of claim 8 wherein the guide member is a generally rhomboidal member having a tapered coin engaging edge to orient each coin in a flat upright, on edge position.

10. The coin hopper of claim 8 wherein at least one mounting screw having a tension spring attaches the guide member to the pay out chute.

11. A coin hopper assembly comprising:

(a) a hopper frame having a mounting plate attached thereto, (b) a hopper basket mounted to the mounting plate, (c) a shelf plate mounted to the mounting plate inside the hopper basket, the shelf plate including a pin wheel, (d) a pay out chute mounted on the hopper frame, (e) a hopper knife attached to an entry end of the pay out chute and operatively associated with the hopper basket, and (f) a guide member mounted on the pay out chute and oriented adjacent the hopper knife, the guide member being a generally rhomboidal member having a tapered coin engaging edge overlying the pinwheel to orient each coin in a flat upright, on edge position, and (g) and at least one mounting screw having a tension spring which attaches the guide member to the pay out chute whereby cons leaving the pin wheel and passing onto the hopper knife are oriented to enter the pay out chute.

* * * * *